US006318498B1

(12) United States Patent
Warner

(10) Patent No.: US 6,318,498 B1
(45) Date of Patent: Nov. 20, 2001

(54) COLLAPSIBLE LADDER

(76) Inventor: Ed Warner, 40 Pallo Close, Red Deer, Alberta (CA), T4P 1J3

( * ) Notice: Subject to any disclaimer, the term of this patent is extended or adjusted under 35 U.S.C. 154(b) by 0 days.

(21) Appl. No.: 09/591,948

(22) Filed: Jun. 12, 2000

(51) Int. Cl.[7] ..... E06C 1/00

(52) U.S. Cl. ..... 182/164; 182/156; 182/159; 182/163

(58) Field of Search ..... 182/41, 156, 159, 182/163, 164, 165, 196, 219

(56) References Cited

U.S. PATENT DOCUMENTS

| | | | | |
|---|---|---|---|---|
| 2,662,681 | * | 12/1953 | Stapleton | 182/163 |
| 3,730,295 | * | 5/1973 | Deese | 182/163 |
| 4,189,028 | * | 2/1980 | Reinhard | 182/160 |
| 4,231,449 | * | 11/1980 | Laurita | 182/164 |
| 4,425,983 | * | 1/1984 | Reinhard | 182/96 |
| 4,884,659 | | 12/1989 | Chao | 182/164 |
| 5,024,292 | * | 6/1991 | Gilbreath et al. | 182/163 |
| 5,026,198 | * | 6/1991 | Lin | 182/163 |
| 5,050,706 | * | 9/1991 | Cole et al. | 182/78 |
| 5,944,141 | * | 8/1999 | Kochan et al. | 182/163 |
| 5,992,566 | * | 11/1999 | Yeh | 182/163 |
| 6,119,811 | * | 9/2000 | Tsung-Ping | 182/164 |
| 6,145,621 | * | 11/2000 | Nye | 182/159 |

* cited by examiner

*Primary Examiner*—Bruce A. Ley
(74) *Attorney, Agent, or Firm*—David S. Thompson

(57) ABSTRACT

A collapsible ladder provides a plurality of segments, each segment associated with one rung of the ladder. The segments may be folded into a flat or planar configuration, after which each segment may be folded against adjacent segments, thereby forming a stacked storage configuration. Each segment provides a generally horizontally oriented rung carried at either end by a generally vertically oriented inside element. A middle element is hinged to each inside element, and an outside element is hinged to each middle element. Side rails may be formed by folding the middle element at 90 degrees to the inside element, and the outside element at 90 degrees to the middle element. A side rail formed in this manner is generally U-shaped when viewed from the end. Springs bias the inside, middle and outside elements into a 90 degree relationship with each adjacent element. A pair of stop pieces, carried by the middle element, maintains the angles between the inside and middle, and between the middle and outside elements, at 90 degrees.

2 Claims, 6 Drawing Sheets

COLLAPSIBLE LADDER

CROSS-REFERENCES

There are no applications related to this application filed in this or any foreign country.

BACKGROUND

This invention relates to a foldable or "collapsible" ladder. In general, emergency ladders of the types used in fire escapes are rather bulky or do not provide the stability of steps and side rails present in conventional ladders. Moreover, such ladders are not always readily transformed from a storage or folded condition to an extended or use condition.

As a result, foldable or collapsible ladders are known. Such ladders comprise segments which fold flat against each other when not in use, and which assume a three-dimensional form when extended for use.

What is needed is a collapsible ladder which comprises segments which fold flat against each other when in storage, which are easily manufactured and which provide the structures required to cause the side elements in each segment to be held in the proper relative position, and which provides the required overall strength.

SUMMARY

The present invention is directed to an apparatus that satisfies the above needs. A novel collapsible ladder includes some or all of the following structures.

(A) A collapsible ladder is formed of a plurality of segments, each segment having a single rung and a side rail on either side of the rung. Each segment is movable between a flat storage position and an in-use position wherein the elements forming the side rails on opposed sides of the rung are oriented in a substantially U-shaped cross-section.

(B) A pair of generally vertically oriented inside elements support a generally horizontally oriented rung between them.

(C) A middle element is pivotally carried by each inside element, and movable about a hinge between an orientation wherein the middle element is in the same plane as the adjacent inside element to an orientation wherein the middle element is perpendicular to the inside element.

(D) An outside element is pivotally carried by each middle element, and movable about a hinge between an orientation wherein the outside element is in the same plane as the adjacent middle element to an orientation wherein the outside element is perpendicular to the middle element.

(E) A pair of springs bias the inside and outside elements into a 90-degree relationship with the adjacent middle element, thereby assuming the in-use configuration having a U-shaped cross-section. The springs are arrayed in an X-configuration when viewed from the end of the ladder. Each spring is attached to an outer element on one side of the rung and an inner element on the other side of the rung. The springs cross midway between the siderails. It is therefore a primary advantage of the present invention to provide a novel collapsible ladder having segments, wherein each segment is formed of a rung flanked on both the left and right by inside, middle and outside elements, and wherein the angle between the inside and middle elements, and between the middle and outside elements, is fixed at 90 degrees when the ladder is in the extended or use position.

Another advantage of the present invention is to provide a collapsible ladder having segments comprising inside, middle and outside elements, each of which carried a plurality of reinforcements.

Another advantage of the present invention is to provide a collapsible ladder wherein the rung is located closer to one end of the inside elements supporting it, and which therefore allows adjacent rungs to be separated sufficiently when the ladder is folded for storage to allow the rungs to be thicker than the inside, middle and outside elements, and to therefore result in a collapsible ladder which is stronger than known collapsible ladders.

A still further advantage of the present invention is to provide a collapsible ladder wherein in a preferred version the rung of each segment is extruded from aluminum stock, but wherein the inside, middle and outside elements are formed of cast aluminum, thereby combining the best qualities of different materials for a preferred overall combination.

Other objectives, advantages and novel features of the invention will become apparent to those skilled in the art upon examination of the invention and the accompanying drawings.

DRAWINGS

These and other features, aspects, and advantages of the present invention will become better understood with regard to the following description, appended claims, and accompanying drawings where:

DESCRIPTION

Figure 1:
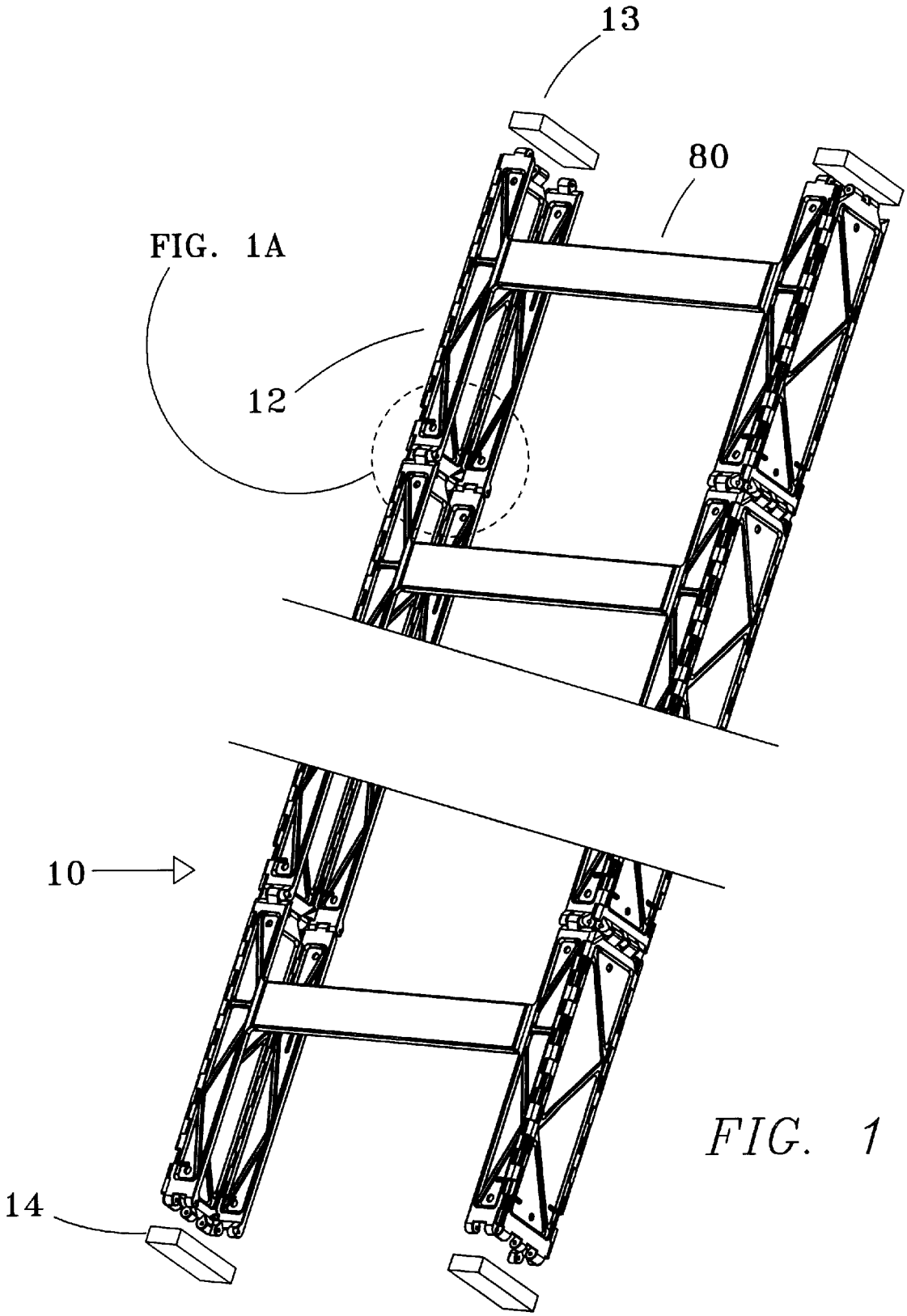
FIG. 1 is a orthographic view of one segment of a version of the ladder of the invention, oriented for use.
Figure 2:
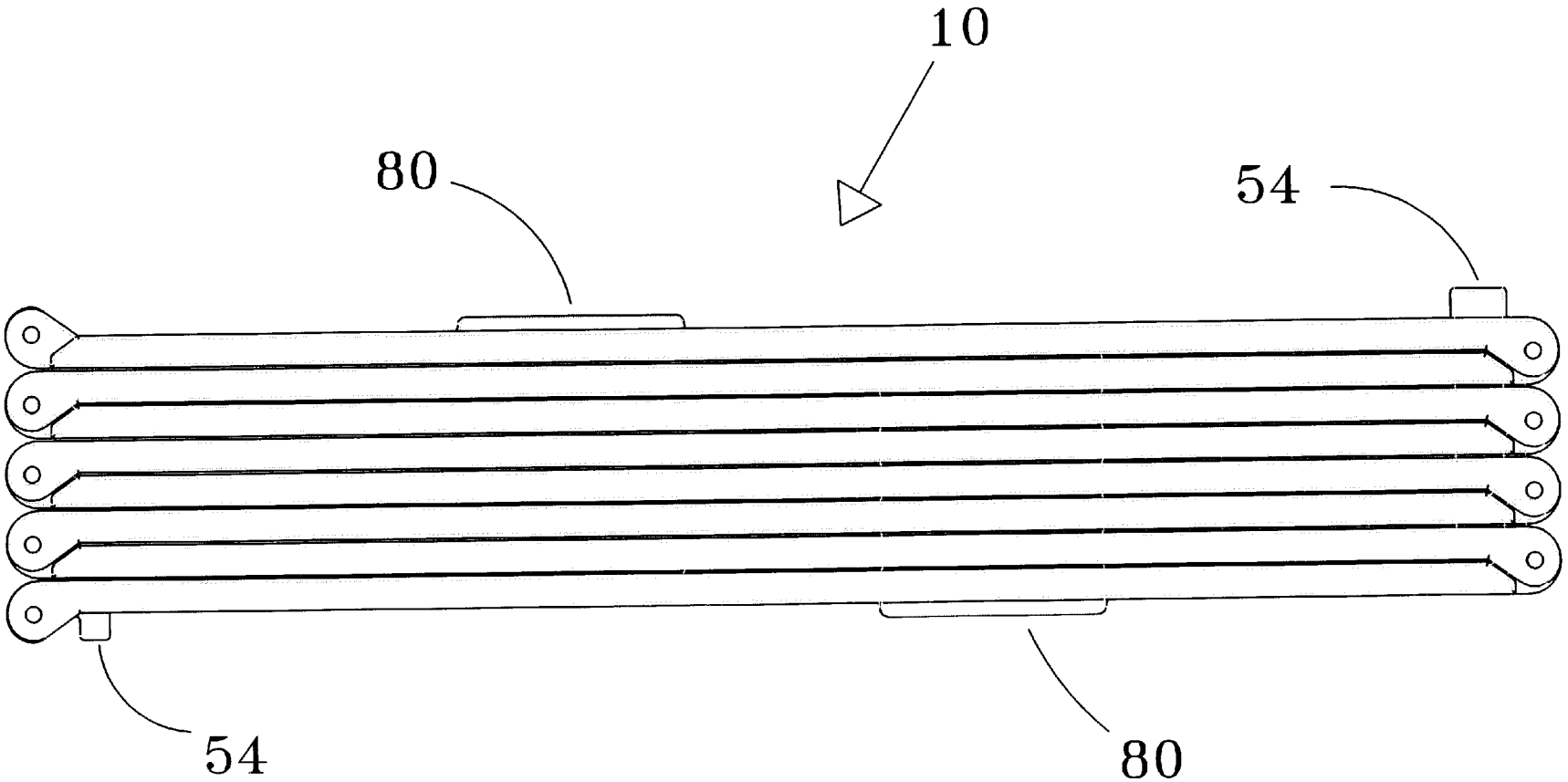
FIG. 2 is an isometric side view of a plurality of segments of the ladder of FIG. 1, oriented for storage.
Figure 3:
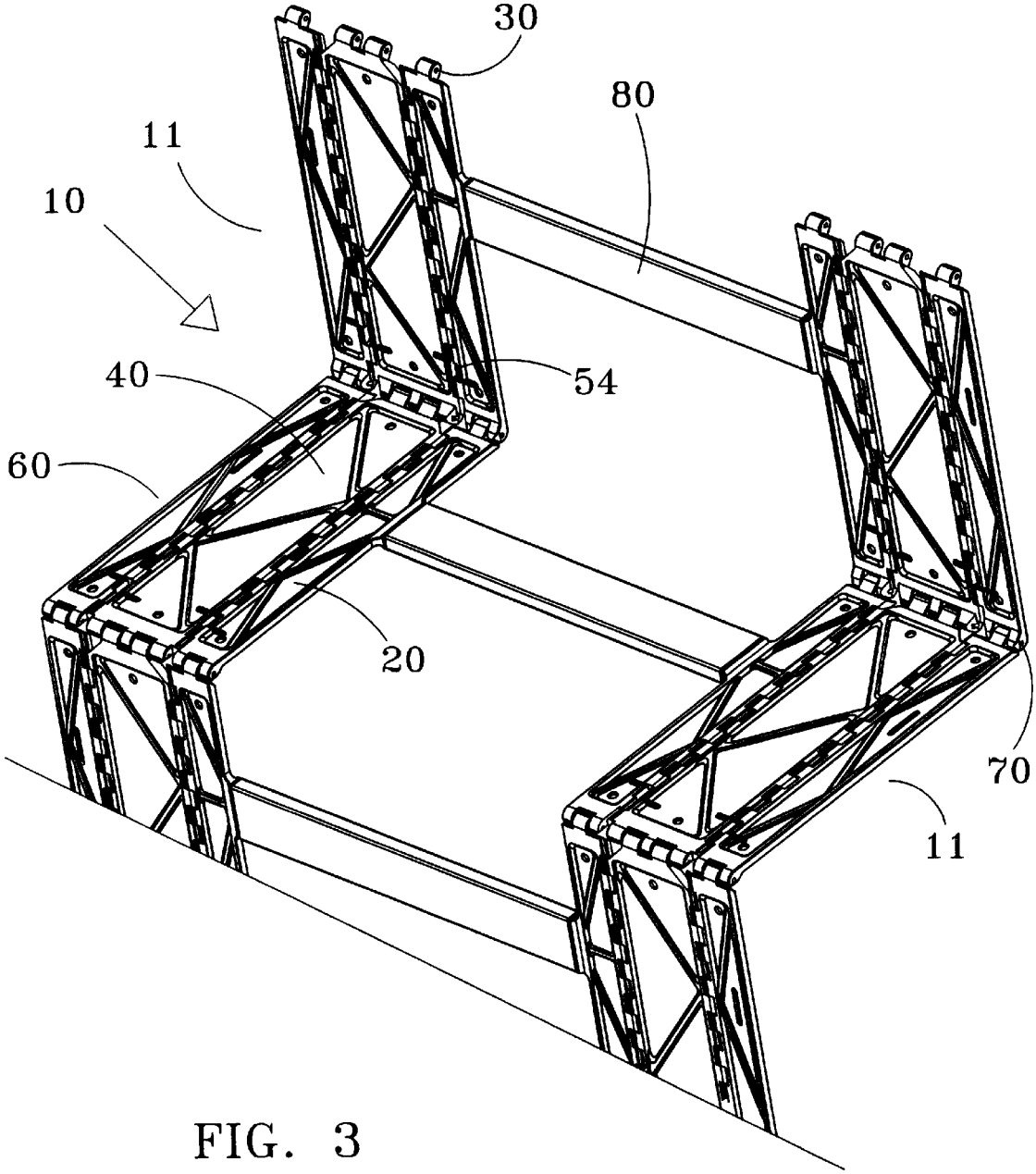
FIG. 3 is an isometric view of a two and a half segments partially folded, wherein the inside, middle and outside elements are folded in a planar configuration.
Figure 5:
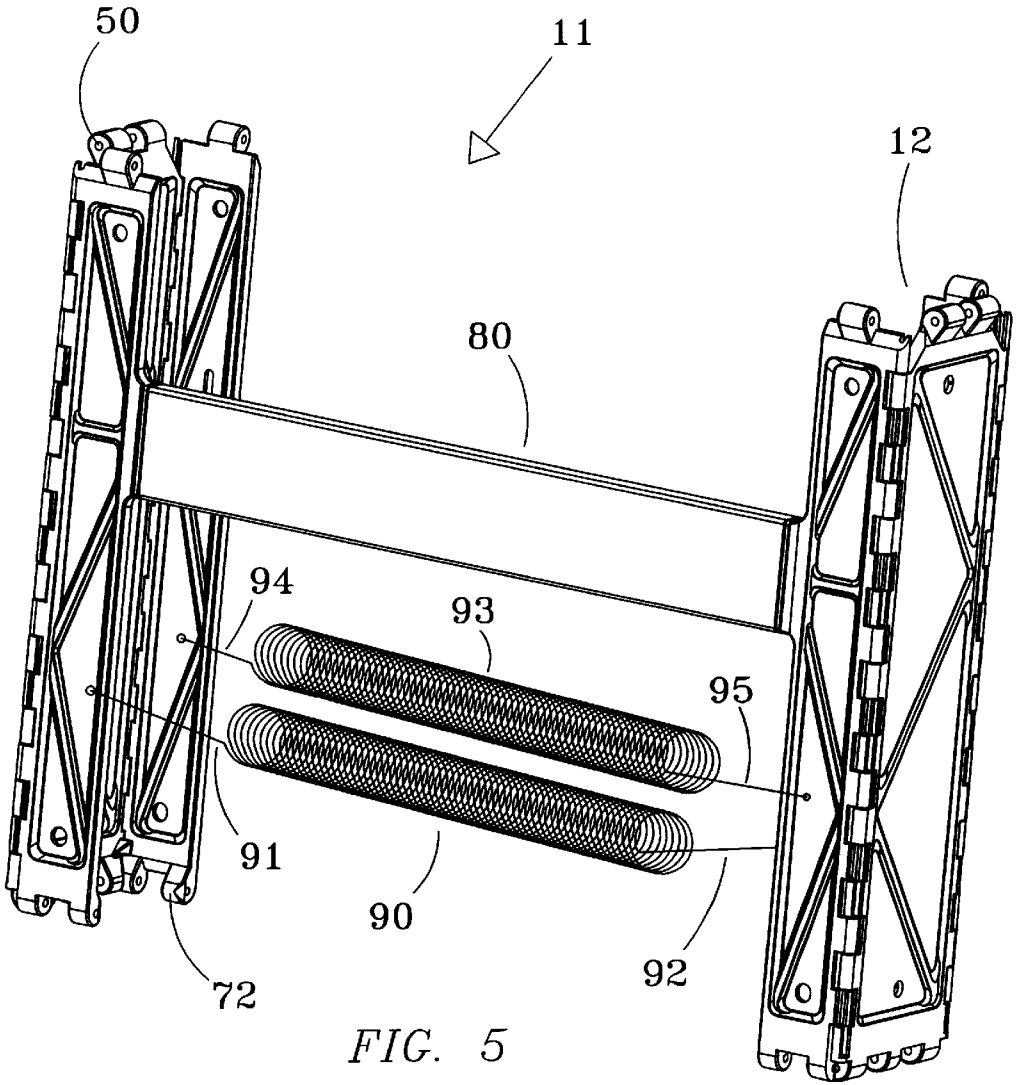
FIG. 5 is an isometric view of a single segment of the ladder, particularly illustrating how springs may be used to bias the ladder into the in-use position.

Referring in generally to the figures, a collapsible ladder 10 provides a plurality of segments 11, each segment associated with one rung 80 of the ladder. The segments may be folded into a flat or planar configuration, as seen in FIG. 3, after which each segment may be folded against adjacent segments, thereby forming a stacked storage configuration, as seen in FIG. 2. Each segment provides a generally horizontally oriented rung 80 carried at either end by a generally vertically oriented inside element 20. A middle element 40 is hinged to each inside element, and an outside element 60 is hinged to each middle element. When all of the segments are oriented for use, as seen in FIGS. 1 and 5, side rails 12 are formed by folding the middle element at 90 degrees to the inside element, and the outside element at 90 degrees to the middle element. A side rail formed in this manner is generally U-shaped when viewed from the end. A pair of stop pieces, carried by the middle element, maintains the angles between the inside and middle, and between the middle and outside elements, at 90 degrees. One pair of springs 90 associated with the entire ladder bias the inside, middle and outside elements into a 90 degree relationship with each adjacent element. A top protector 13 prevents the ladder from damaging a supporting structure, while a bottom foot 14 prevents the ladder from slipping or damaging the floor.

The reader is hereby directed to the description, specification and drawing figures of the collapsible ladder disclosed in U.S. Pat. No. 4,884,659, issued Dec. 5, 1989 to Patrick Chao, which is hereby incorporated by reference.

Figure 4:
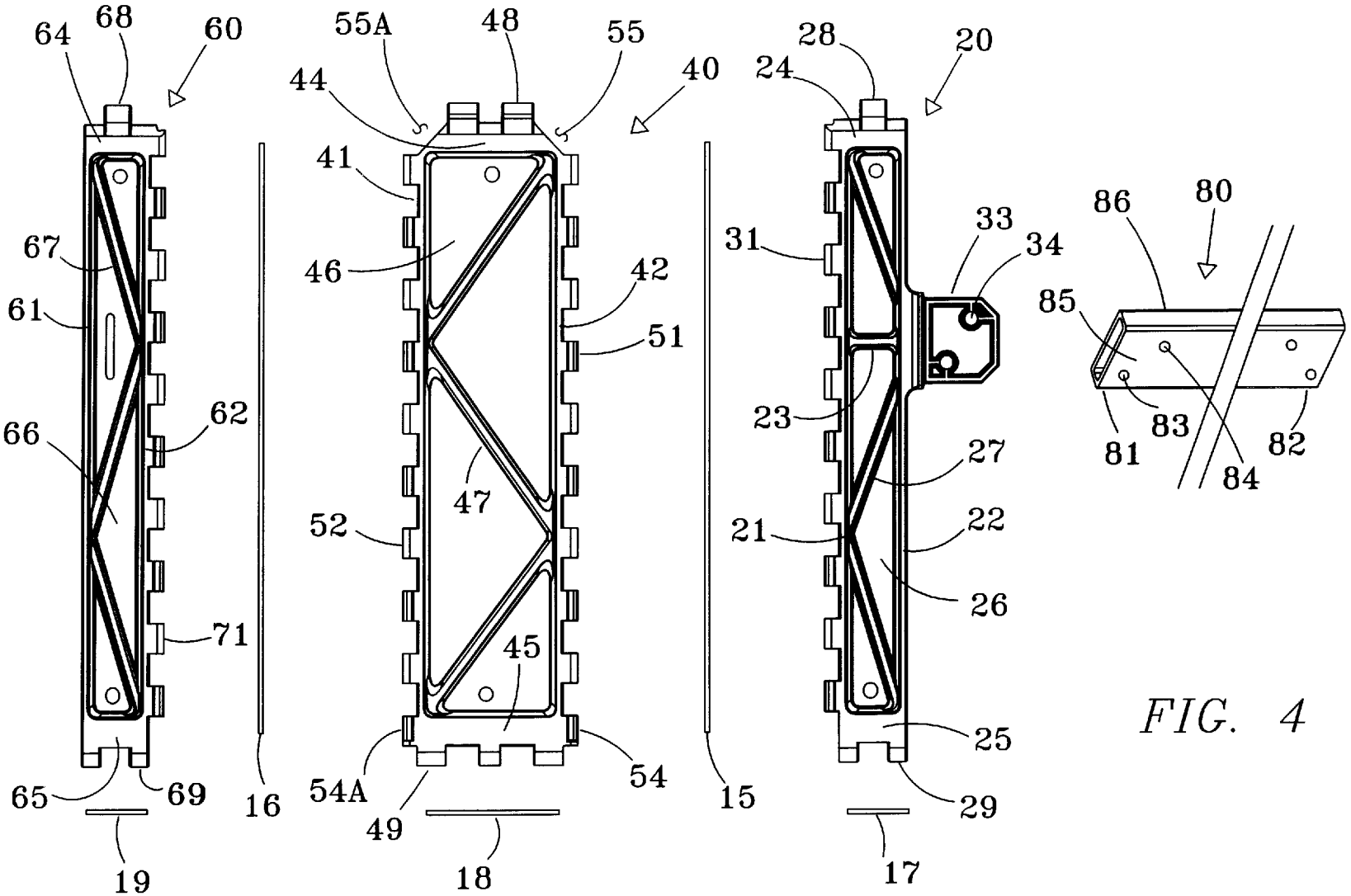
FIG. 4 is an orthographic view of the inside, middle and outside elements separated to more clearly illustrate their structure, and an isometric view of the rung, to better illustrate how it connects to the inside elements.

Referring in generally to FIGS. 3, 4 and 5, a preferred version of an inside element 20 is seen. As seen in FIGS. 3 and 5, a pair of inside elements support the opposed ends of the rung 80. In a preferred embodiment of the invention, each inside element is formed of cast aluminum, but could alternatively be made of a different material having adequate strength and weight characteristics.

Referring to FIG. 4, a preferred inside element is strengthen by a perimeter formed of an outside reinforcement 21, an inside reinforcement 22, a top reinforcement 24 and a bottom reinforcement 25. One or more horizontal reinforcement 23 are perpendicular to the length of the inside element. One or more diagonal reinforcements 27 add additional strength. The body of the inside element, within regions surrounded by the reinforcements, is made of plate 26 which is thinner than the reinforcing members.

Continuing to refer in particular to FIG. 4, a single upper lug 28 and a pair of lower lugs 29 are seen. A hole 30 defined in each lug allows the single upper lug of a first inside element to be attached between the pair of lower lugs of an adjacent inside element by a pin 17 or similar fastening structure.

As seen particularly in FIGS. 2, 3 and 5, the center of the hole 30 defined within the upper lug, and the center of the holes defined in the lower lugs are oriented to allow adjacent inside elements to be stacked for storage, as seen in FIG. 2. That is, the centers of the holes are in the same plane as the surface of opposite sides of the inside element.

A plurality of outside side lugs 31 are carried by the outside edge of the inside element. Each outside side lug provides a wrap-around arm 32 which is sized to wrap about the hinge pin 15 about which adjacent inside and middle elements pivot.

A fastening support 33 attaches to, and supports, one end of the rung 80 carried by the segment 11. The fastening support extends perpendicularly from the inside surface of the inside element a sufficient distance to allow a rigid connection to be made. In a typical fastening support, two fastening holes 34 are defined, allowing bolts, rivets or similar fasteners to connect the fastening support to an end of the rung.

As seen in FIGS. 1, 2 and 3, to allow the rung of the ladder segment to be thicker than the inside, middle and outside elements, the fastening supports are attached to the inside element in a location that is not equally distant from the top reinforcement 24 and the bottom reinforcement 25. This is most easily seen in FIGS. 2–4, where the rungs of adjacent ladder segments 11 are separated.

Referring in generally to FIGS. 1, 3, 4 and 5, a preferred version of a middle element 40 is seen. As seen in FIG. 4, a middle element pivots about a hinge pin 15 with an adjacent inside element. In a preferred embodiment of the invention, each middle element is formed of cast aluminum, but could alternatively be made of a different material having similar strength and weight characteristics.

Continuing to refer to FIG. 4, a preferred middle element is strengthen by a perimeter formed of an outside reinforcement 41, an inside reinforcement 42, a top reinforcement 44 and a bottom reinforcement 45. One or more diagonal reinforcements 47 add additional strength. The body of the middle element, within regions surrounded by the reinforcements, is made of plate 46 which is thinner than the reinforcing members.

Continuing to refer to FIG. 4, two upper lugs 48 and three lower lugs 49 are seen. A hole 50 defined in each lug allows the two upper lugs of a first middle element to be attached to the three lower lugs of an adjacent inside element by a hinge pin 18 or similar fastening structure.

As seen particularly in FIG. 3, the center of the hole 50 defined within the upper lugs, and the center of the holes defined in the lower lugs, are oriented allow adjacent middle elements to be stacked for storage, as seen in FIG. 2. That is, the centers of the holes are in the same plane as the surface of opposite sides of the middle element.

A plurality of inside side lugs 51 and outside side lugs 52 are carried by the inside edge and outside edge, respectively, of the middle element. Each lug provides a wrap-around arm 53 which is sized to wrap about the hinge pins 15, 16 about which adjacent inside and middle, and adjacent middle and outside elements, respectively, pivot.

Figure 1A:
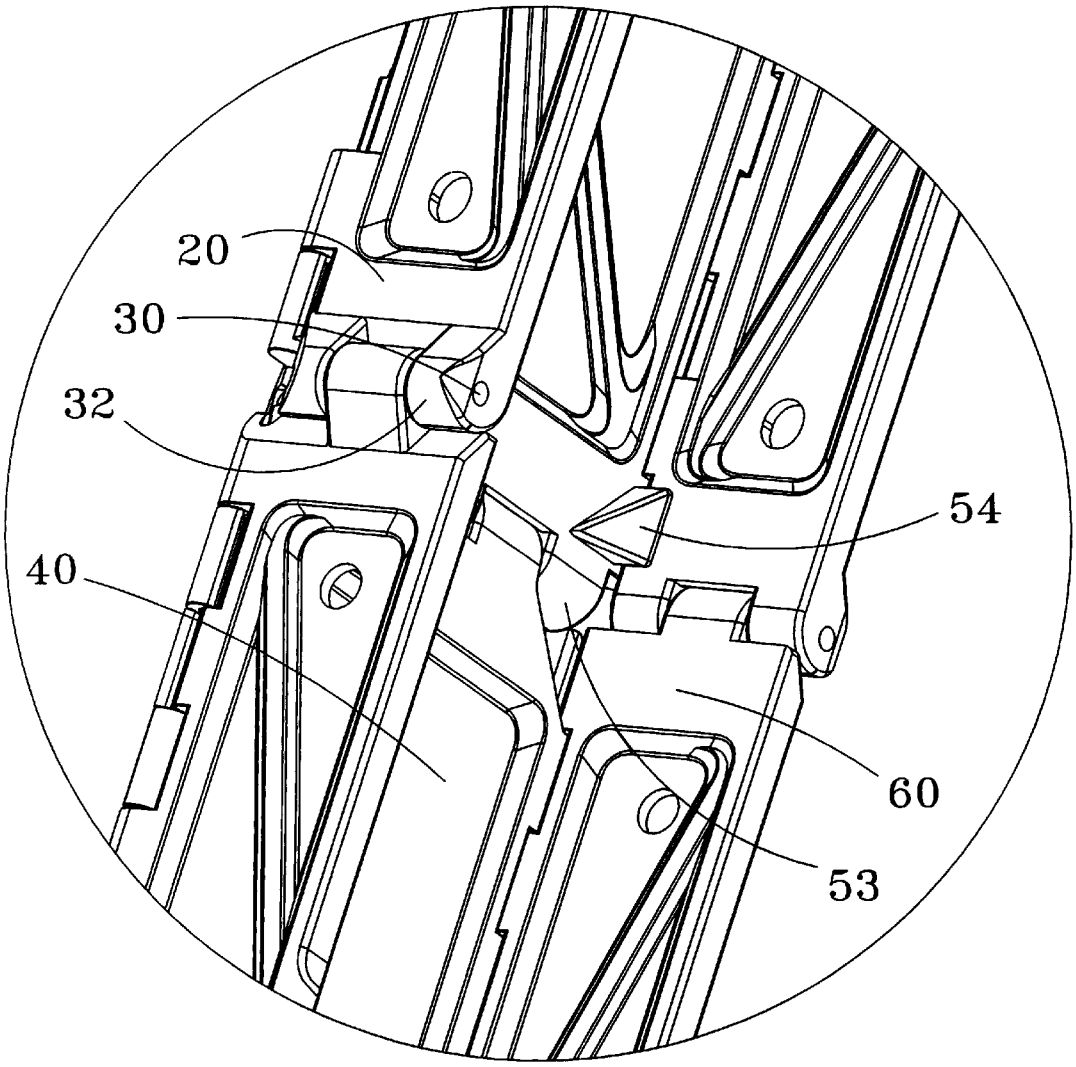
FIG. 1A is an enlarged view of the portion of FIG. 1 enclosed by the dashed-line circle.

As is best seen in FIG. 1A, first and second stop pieces 54, 54A are defined on opposed sides of the lower surface of the middle element. Each of the stop pieces presents a surface which stops the movement of the inside element and outside element, respectively, when the angle between the inside element and middle element and the angle between the middle element and outside element, respectively, is 90 degrees. Thus, the first and second stop pieces prevent the middle element from pivoting too much with respect to the inner element, and the outside element from pivoting too much with respect to the middle element. As seen in FIG. 1A, a preferred stop piece is a five-sided pyramid, although alternative shapes can be substituted.

Continuing to refer to FIGS. 1A and 3, first and second stop piece recesses 55, 55A are defined on opposed sides of the end of the middle element opposite the first and second stop pieces. The stop piece recesses provide space for the stop pieces of adjacent ladder segments 11 when the collapsible ladder is in the storage position seen in FIG. 2. As seen in FIG. 1A, the preferred stop piece recess is generally defined by a triangular opening.

Referring in generally to FIGS. 1–5, a preferred version of an outside element 60 is seen. As seen in FIG. 1, a outside element pivots about a hinge pin 16 with an adjacent middle element. In a preferred embodiment of the invention, each outside element is formed of cast aluminum, but could alternatively be made of a different material having similar strength and weight characteristics.

Referring to FIG. 4, a preferred outside element is strengthen by a perimeter formed of an outside reinforcement 61, an inside reinforcement 62, a top reinforcement 64 and a bottom reinforcement 65. One or more diagonal reinforcements 67 add additional strength. The body of the outside element, within regions surrounded by the reinforcements, is made of plate 66 which is thinner than the reinforcing members.

Continuing to refer to FIG. 4, an upper lug 68 and a pair of lower lugs 69 are seen. A hole 70 defined in each lug allows the upper lug of a first outside element to be attached to the pair of lower lugs of an adjacent outside element by a hinge pin 19 or similar fastening structure.

As seen particularly in FIG. 6A, the center of the hole 70 defined within the upper lug, and the center of the holes defined in the lower lugs, are oriented allow adjacent outside elements to be stacked for storage, as seen in FIG. 2. That is, the centers of the holes are in the same plane as the surface of opposite sides of the outside element.

A plurality of inside side lugs 71 are carried by the inside edge of the outside element. Each lug provides a wrap-around arm 72 which is sized to wrap about the hinge pin 16 about which adjacent middle and outside elements pivot.

Referring in particular to FIGS. 1, 3 and 4, a preferred version of the rung 80 is seen. A preferred rung is made of extruded aluminum, and is thicker, i.e. the distance between the front and rear surfaces 85, 86 is greater, than the thickness of the inside, outside and middle elements. This results in a rung having greater strength than would otherwise be the case. To facilitate this greater thickness of the rungs, each rung is attached to respective pairs of inside elements 20 at a location closer to the top reinforcement 24 than the bottom reinforcement 25 (or the reverse). As a result, when adjacent segments 11 of the collapsible ladder are folded upon each other, the rungs associated with each segment are a spaced distance apart.

First and second ends 81, 82 of the rung are supported by the fastening supports 33 of the inside elements 20. In a preferred embodiment, holes 83, 84 defined in the first and second ends of the rung allow fasteners to be used to secure the ends of the rung to the fastening supports 33.

As seen in FIG. 5, first and second springs 90, 93 bias the inside and middle elements to the in-use position seen in FIG. 1. In a preferred application, the springs 90, 93 are attached to a middle segment 11 of the ladder; i.e., each segment does not have a pair of springs, as only one pair of springs is required to bias the entire ladder to the in-use position.

As seen in FIG. 5, a first end 91 of the first spring 90 is attached to a location on the inside element 20 on a first side of the rung 80 of a middle segment 11 of the ladder 10. A second end 92 of the first spring 90 is attached to a location on the outside element 60 on a second side of the rung 80 of the middle segment of the ladder.

Similarly in FIG. 5 it can be seen that a first end 94 of the second spring 93 is attached to a location on the outside element 60 on the first side of the rung 90 of the middle segment 11 of the ladder 10. A second end 95 of the second spring 93 is attached to a location on the inside element 20 on the second side of the rung 80 of the middle segment of the ladder.

As a result, the ladder is biased into the in-use configuration seen in FIG. 5, wherein the spring is relaxed. When the ladder is in the storage configuration seen in FIG. 2, or the intermediate configuration seen in FIG. 3, the spring is extended.

To use the collapsible ladder 10, from the storage configuration of FIG. 2, the user unfolds the segments 11, as seen in FIG. 3, until the entire ladder is oriented in a planar configuration. At this time, the springs 90, 93 carried by a middle segment 11 will bias the middle elements 40 to a 90 degree relationship with the inside elements 20, and the outside elements 60 to a 90 degree relationship with the middle elements. The movement of the elements 20, 40, 60 will be fixed at 90 degrees with respect to adjacent elements due to the stop pieces 54, 54A, which prevent pivoting more than 90 degrees. At this point, the inside, middle and outside elements will have formed side rails 12, as seen in FIG. 1, and the ladder is ready for use.

To store the ladder, the ladder is laid flat and the outside elements are manually forced against the bias of the springs 90, 93 into a planar relationship with the middle elements, and the middle elements are similarly manually forced against the bias of the springs into a planar relationship with the inside elements. At this point, the segments 11 of the ladder may be folded, as seen in FIG. 3, until they are fully stacked, as seen in FIG. 2. It should be noted that the stop pieces 54, 54A move into the stop piece recesses 55, 55A, in the storage configuration. Also, due to the attachment of the rungs to a location other than the middle of the inside elements, the rungs of adjacent segments do not touch, and are staggered, as can be understood by examination of FIGS. 2 and 3.

The previously described versions of the present invention have many advantages, including a primary advantage of providing a novel collapsible ladder having segments, wherein each segment is formed of a rung flanked on both the left and right by inside, middle and outside elements, and wherein the angle between the inside and middle elements, and between the middle and outside elements, is fixed at 90 degrees when the ladder is in the extended or use position.

Another advantage of the present invention is to provide a collapsible ladder having segments comprising inside, middle and outside elements, each of which carried a plurality of reinforcements.

Another advantage of the present invention is to provide a collapsible ladder wherein the rung is located closer to one end of the inside elements supporting it, and which therefore allows adjacent rungs to be separated sufficiently when the ladder is folded for storage to allow the rungs to be thicker than the inside, middle and outside elements, and to therefore result in a collapsible ladder which is stronger than known collapsible ladders.

A still further advantage of the present invention is to provide a collapsible ladder wherein in a preferred version the rung of each segment is extruded from aluminum stock, but wherein the inside, middle and outside elements are formed of cast aluminum, thereby combining the best qualities of different materials for a preferred overall combination.

Although the present invention has been described in considerable detail and with reference to certain preferred versions, other versions are possible. For example, while a preferred size, shape and configuration for the stop piece has been illustrated and described, it is clear that some alteration of the exact size and shape could be resorted to, while still in keeping within the spirit of the invention. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A collapsible ladder, comprising:

(A) at least two segments, each segment comprising:

(a) a rung, having a first and a second end;

(b) first and second inside elements having first and second fastening supports supporting the first and second ends of the rung, wherein the distance between each fastening support and a top edge of each inside element is not equal to a second distance between each fastening support and a bottom edge of each inside element;

(c) first and second middle elements, pivotally carried by the first and second inside elements, respectively, and movable between a first orientation wherein the middle element is in the same plane as the adjacent inside element to a second orientation wherein the middle element is perpendicular to the inside element; and (d) first and second outside elements, pivotally carried by the first and second middle elements, respectively, and movable between a first orientation wherein the outside element is in the same plane as the adjacent middle element, to a second orientation wherein the outside element is perpendicular to the middle element;

(B) first spring means, carried between an inside element on a first side of the rung and an outside element on a second side of the rung, for biasing the inside element at 90 degrees to the middle element and for biasing the middle element at 90 degrees to the outside element; and (C) second spring means, carried between an inside element on the second side of the rung and an outside element on the first side of the rung, for biasing the inside element at 90 degrees to the middle element and for biasing the middle element at 90 degrees to the outside element.

2. A collapsible ladder, comprising:

(A) at least two segments, the segments movable between a storage position and an in-use position, each segment comprising:

(a) a rung, having a first and a second end;

(b) first and second inside elements having first and second fastening supports extending from the first and second inside segments, wherein the first and second fastening supports support the first and second ends of the rung, and wherein the first and second fastening supports are not equally distant between a top edge of each inside element and a bottom edge of each inside element;

(c) first and second middle elements, pivotally carried by the first and second inside elements, respectively, and movable between a first orientation wherein the middle element is in the same plane as the adjacent inside element to a second orientation wherein the middle element is perpendicular to the inside element, the first and second middle elements each defining two stop pieces and two stop recesses, whereby the stop piece carried by a first segment is carried within the stop recess of a second segment adjacent to the first segment when the segments are in the storage position;

(d) first and second outside elements, pivotally carried by the first and second middle elements, respectively, and movable between a first orientation wherein the outside element is in the same plane as the adjacent middle element, to a second orientation wherein the outside element is perpendicular to the middle element; and (e) wherein the rung is made of extruded aluminum, and the first and second inside elements, middle elements and outside elements are made of cast aluminum, and wherein the rung is thicker than the first and second inside elements, middle elements and outside elements;

(B) first spring means, carried between an inside element on a first side of the rung and an outside element on a second side of the rung, for biasing the inside element at 90 degrees to the middle element and for biasing the middle element at 90 degrees to the outside element; and (C) second spring means, carried between an inside element on the second side of the rung and an outside element on the first side of the rung, for biasing the inside element at 90 degrees to the middle element and for biasing the middle element at 90 degrees to the outside element.

* * * * *